United States Patent [19]

Beisler

[11] 4,241,677

[45] Dec. 30, 1980

[54] TWO NEEDLE SEWING MACHINE

[75] Inventor: Alfons Beisler, Goldbach, Fed. Rep. of Germany

[73] Assignee: Velva AG, Locarno-Muralto, Switzerland

[21] Appl. No.: 51,460

[22] Filed: Jun. 25, 1979

Related U.S. Application Data

[63] Continuation-in-part of Ser. No. 858,356, Dec. 12, 1977, abandoned.

[30] Foreign Application Priority Data

Dec. 7, 1976 [DE] Fed. Rep. of Germany ..... 2655283

[51] Int. Cl.[3] ..... D05B 1/08

[52] U.S. Cl. ..... 112/167; 112/221

[58] Field of Search ..... 112/221, 153 R, 158 E, 112/71, 98, 167

[56] References Cited

U.S. PATENT DOCUMENTS

| | | | |
|---|---|---|---|
| 836,250 | 11/1906 | Haase | 112/158 R |
| 1,164,789 | 12/1915 | Voe | 112/158 R |
| 1,386,323 | 8/1921 | Voe | 112/221 |
| 1,474,269 | 11/1923 | Lautenschlager | 112/158 R |
| 1,726,922 | 9/1929 | Reece | 112/158 R |
| 2,322,523 | 6/1943 | Kierner | 112/158 R |
| 2,407,148 | 9/1946 | Garcia | 112/221 X |
| 3,339,507 | 9/1967 | Taketomi | 112/158 R |
| 3,481,291 | 1/1969 | Schilling | 112/158 R |

*Primary Examiner*—Ronald Feldbaum

*Attorney, Agent, or Firm*—Ross, Ross & Flavin

[57] ABSTRACT

The invention provides a twin-needle sewing machine for stagger sewing, wherein a needle bar is angularly adjustable transversely to its longitudinal axis and is so guided as to be longitudinally displaceable in an angularly adjustable holder. Herewith, two needles may be placed in a plane extendable parallel to the obliquely extending edge of the material part to be sewn on. With the obliquely cut-up material part fed with the material part to be sewn on, at the start of the sewing, both needles will penetrate simultaneously into the material part to be sewn on. Even in the case of obliquely running-on or feeding material pieces, sewing can be effected in a locking manner.

9 Claims, 5 Drawing Figures

TWO NEEDLE SEWING MACHINE

This application is a continuation-in-part of application Ser. No. 858,356 filed Dec. 12, 1977, now abandoned.

The invention relates to a two-needle sewing machine and includes a needle-bar drive, a needle bar coupled to the needle-bar drive and reciprocable in the direction of its longitudinal axis and inclusive of a pair of needles which, considered in the feed direction of the goods to be sewn, are arranged substantially side-by-side, a holder for guidance of the needle bar upon its reciprocation, a sewing table having passage apertures for the needles, and a pair of rotary grippers arranged underneath the sewing table and being rotative about axes parallel to the longitudinal axis of the needle bar.

In the sewing industry, often parts having oblique edges have to be processed on a two-needle sewing machine. This applies, for example, to flaps or tabs or straps which have side edges extending obliquely to their longitudinal edges. In the case of such, because of their design, it is not possible, on a two-needle sewing machine of the above-mentioned kind, to lock the seam at its start and at its finish by repeated forward and backward sewing strokes, since the two needles lie in a plane extending perpendicular to the feed direction, while the edges of the part, at which the seams to be produced by the two needles are supposed to begin and to end, extend obliquely to the feed direction. Consequently, for example upon commencement of sewing, the one needle will already penetrate into the part that is to be sewn on, while the other needle will have still not yet grasped the part in the first instance.

Underlying the invention is the solution to the problem of allowing a locking sewing-on of the parts, even in the case of parts having edges extending obliquely to the seam.

In accordance with the invention, this problem is solved in that the needle bar is guided in a torsionally-fast manner in the holder, with the holder being adjustable about the longitudinal axis of the needle bar between a normal position (in which a needle plane extends through both needles is directed substantially perpendicularly to the feed direction of the goods to be sewn) and at least one oblique position (in which a needle plane is directed obliquely to the feed direction, and with the passage apertures being formed by slotted holes which are curved in a circular-arc-shaped manner about the longitudinal axis of the needle bar, the length of which corresponds, in the angular measurement to the adjusting angle of the holder.

Thus, in the case of the two-needle sewing machine in accordance with the invention, it is possible to place the two needles in such a way that their needle plane extends parallel to an obliquely-extending edge of a material part that is to be sewn on. If then the obliquely-cut-up material part is fed with its substrate on which is to be sewn, and the sewing machine is set in motion, at the start of the sewing operation, both sewing needles penetrate simultaneously and at the same distance from the obliquely-extending edge into the material part which is to be sewn on. Consequently, even in the case of obliquely tapering pieces, a locking of the seam at the start and finish of the seam can be successfully carried out.

As is known, the needles form, after exceeding their lower reversal point out of the upper thread, a loop into which the respective rotary gripper engages with its gripper tip. Surprisingly, it has become apparent that, with an adjustment of the needle plane relative to the normal position through an angle of up to about 20°, as a result of the varied needle position compared with the respective rotary gripper, no difficulties occur when the thread noose is grasped by the gripper tip, since the thread noose is generally large enough to allow an engaging of the gripper tip into the thread noose, even when the needle in the oblique position has a greater spacing from the circle, traversed by the gripper tip, than in its normal position. Also, the time coordination of the needle movement and the gripper movement presents no difficulty, so long as it is only ensured that the needle has, even in the case where it is adjusted contrary to the direction of rotation of the gripper, upon arrival of the gripper tip at the needle location, already exceeded its lower reversal point.

However, for larger angles up to, for example 30°, the distance between the needle and the circle traversed by the gripper tip would become so great that the gripper tip may possibly no longer grasp the thread noose and thus the risk of defective stitches would arise. For this purpose, in accordance with the invention, the distance of the two needles from one another is selected to be greater than the smallest distance, measured perpendicularly to the feed direction, between a needle protection of the one rotary gripper and the needle guard of the other rotary gripper. The difference in distance may, for example, amount to 1 to 1.5 mm. The result is that, in the normal position of the two needles, each of the needles is forced by the needle guard of the rotary gripper respectively associated with it in the direction of the other needle, so that the needle spacing in the normal position of the needles perforce corresponds to the spacing of the two rotary grippers. If, on the other hand, the needle bar is rotated by the desired amount relative to the normal position, then no pressure is any longer exerted by the rotary grippers on the needles, so that these spring outwardly and thus draw away from one another. In this way, at least part of the spacing which would otherwise occur between the needle and the circle, traversed by the gripper tip, upon the swinging of the needles out of their normal position, is compensated for once more.

Preferably, the holder comprises a U-shaped stirrup, in the U-limbs of which the needle bar is guided so as to be axially displaceable and on the center web of which there is formed a guideway which is directed parallel to the longitudinal axis of the needle bar and on which a guide element, connected in a torsionally-fast manner to the needle bar, is guided in the longitudinal direction of the needle bar. This guideway may, for example, be formed by a groove in the center web, into which the guide element engages.

The holder may be adjustable manually. Preferably, however, an adjusting mechanism is provided for adjusting the holder. The adjusting mechanism advantageously comprises a piston/cylinder arrangement which is actuatable by pressure medium and which has a piston rod which extends perpendicularly to the longitudinal direction of the needle bar and which acts, by way of a linkage connected to it, on a point of the holder which is located outside the longitudinal axis of the needle bar. By actuating the piston/cylinder arrangement, a torque, about the longitudinal axis of the needle bar, can be exerted on the holder.

The various positions of the needles can be fixed in that the linkage is connected to a stop lever, the free end of which is movable, upon the adjustment of the linkage, between a stationary stop and an operationally adjustable stop. The operationally adjustable stop may be adjustable as by means of a second piston/cylinder arrangement which is actuated by pressure medium, between a position which determines the normal position of the needles and a position which determines a second oblique position.

Further features and advantages of the invention will become apparent from the following description which explains the invention, with reference to an exemplified embodiment, in conjunction with the accompanying drawings, in which.

Figure 1:
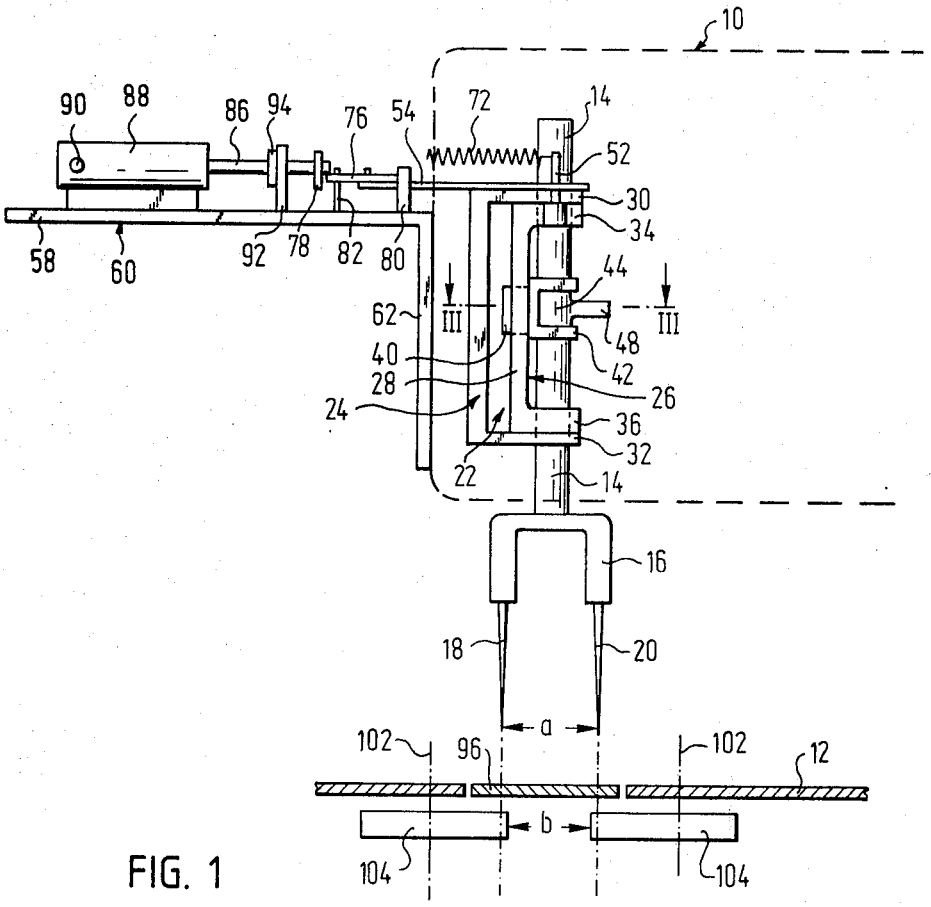
FIG. 1 is a schematic, partially-sectioned side view of the front portion of an arm sewing-machine in accordance with the invention.
Figure 3:
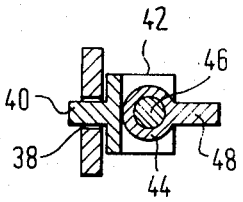
FIG. 3 is a section taken along the line III—III in FIG. 1.

In FIG. 1, a housing 10, indicated by a broken line, of a conventional arm sewing machine, as well as a sewing table 12 underneath housing 10 are shown. Housing 10 will be understood to mount a drive (not shown), for moving a needle bar 14 up and down, which needle bar carries, at its lower end, protruding from housing 10, on a U-shaped stirrup 16, two needles 18 and 20 which, related to the feed direction of the goods to be sewn, are arranged in side-by-side disposition.

Needle bar 14 is held in a holder 22 which comprises a first, U-shaped, housing-fast stirrup 24 and a second U-shaped stirrup 26, the external dimension of which, in the longitudinal direction of its center web 28, is equal to the spacing of U-limbs 30, 32 of first stirrup 24 and which is inserted into first stirrup 24 in such a way that its U-limbs 34, 36 extend parallel to U-limbs 30 or 32 respectively of first stirrup 24.

Needle bar 14 is guided so as to be displaceable, in the direction of its longitudinal axis, in bearings (not shown) in U-limbs 30, 32 and 34, 36 of stirrups 24 or 26 respectively.

To prevent any rotation of needle bar 14 relative to second stirrup 26, second stirrup 26 has, in its central web 28, a groove 38 which extends parallel to the longitudinal axis of the needle bar and into which a finger 40, connected in a torsionally-fast manner to needle bar 14, engages. Finger 40 is part of a U-shaped block 42, the U-limbs of which lie perpendicular to the longitudinal axis of needle bar 14. Between the limbs of block 42, a sleeve 44 is mounted so as to be swingable about a pin 46 which extends coaxially to needle bar 14. Sleeve 44 has a radially-extending adjoint-piece 48 which communicates with the sewing machine drive (not shown, as aforesaid).

Formed on upper limb 34 of second stirrup 26 is an extension 50 which extends substantially radially to needle bar 14 and which carries a pin 52 which is directed with its axis parallel to the longitudinal axis of the needle bar. Hinged to pin 52 is an actuating rod 54 which connects second stirrup 26 to an adjusting mechanism 56 and with the help of which needle bar 14 can be swung about its longitudinal axis. In this way, it is , for example, possible to adjust needle bar 14 in such a way that needles 18 and 20 are disposed either in a plane A—A which extends perpendicular to the feed direction and which characterises the normal position of needles 18 and 20, or else in one of the planes B—B or C—C which are inclined at an angle $\alpha$ or $\beta$ relative to plane A—A.

Adjusting mechanism 56 is arranged on a plate 58 which is formed by one limb of an angle profile 60, the other limb 62 of which is fastened to the end face of housing 10. Plate 58 can, however, otherwise be fastened to a carrier independent of housing 10.

The adjusting mechanism comprises a first piston/-cylinder arrangement 64 which is actuated by pressure medium and which has pressure-medium connections 66 and 68. Piston rod 70 of piston/cylinder arrangement 64 acts with its free end on actuating rod 54 in order to move this in the direction of arrow D. In opposite direction, piston rod 70 and actuating rod 54 are biassed by a tension spring 72 which acts, on the one hand, on a cylinder-fast location 74 and, on the other hand, on pin 52.

The stroke of piston rod 70 and of actuating rod 54 is limited by a one-armed lever 76 and by cooperating stops 78 and 80. Lever 76 is hinged by its one end about a pin 82 directed parallel to pin 52 and fastened to plate 58, and is hingedly connected, at a central point between pin 82 and its feed end, via a pin 84 to actuating rod 54.

Figure 2:
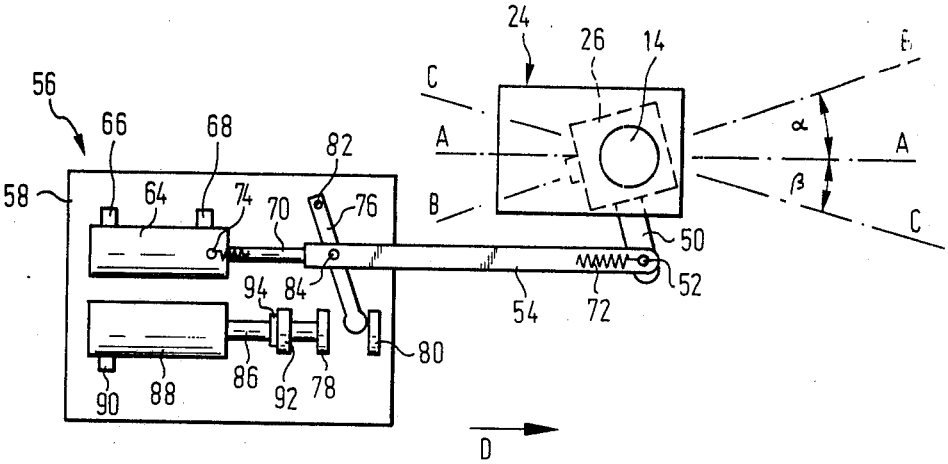
FIG. 2 is a schematic top plan view of the adjusting mechanism for rotating the needle bar.

If piston/cylinder arrangement 64 is supplied with a pressure medium through the pressure-medium connection 66, then piston rod 70 and actuating rod 54 are shifted in the direction of arrow D, until the free end of lever 76 strikes against stop 80 which is rigidly connected to plate 58 as shown in FIG. 2. In this respect, second stirrup 26 and needle bar 14 connected torsionally-fast thereto are swung through the angle $\alpha$, so that needles 18 and 20 now lie in plane B—B.

If piston/cylinder arrangement 64 is supplied with pressure medium through pressure-medium connection 68, then piston rod 70 and actuating rod 54 are displaced contrary to the direction of arrow D, until the free end of lever 76 strikes against adjustable stop 78. Stop 78 is disposed at the free end of piston rod 86 of a piston/cylinder arrangement 88, which has a pressure-medium connection 90. The adjustment path of movable stop 78 is determined, on the one hand, by a stop 92 connected rigidly to plate 58 and which is penetrated by piston rod 86, and, on the other hand, by a stop 94 which is fastened to the piston rod and which is movable therewith.

In FIG. 2, movable stop 78 is shown in an end position in which stop 94 connected to piston rod 86 butts against plate-fast stop 92 and in which movable stop 78 defines, together with the free end of lever 76, the normal position of needle bar 14 in which needles 18 and 20 lie in plane A—A. The retaining of stop 78 in the position shown in FIG. 2 is also possible when lever 76 butts, as a result of piston/cylinder arrangement 65, with its free end against stop 78, since the piston of piston/cylinder arrangement 88 is acted upon on its entire area, whereas the piston of piston/cylinder arrangement 64 is acted upon only on the piston surface reduced by the cross-section of the piston rod.

If pressure-medium connection 90 of second piston/-cylinder arrangement 88 is opened, then the piston rod of this arrangement is run in until movable stop 78 butts against stationary stop 92. In this respect, needle bar 14 is swung, by way of actuating rod 54 and second stirrup 26, to such an extent that needles 18 and 20 lie in plane C—C.

As can be seen, angles $\alpha$ and $\beta$ can easily be varied by stops 80, 92 and 94 being varied. Provision can, for example, be made for the fact that these stops are fastened detachably on plate 58 or piston rod 86 respectively, so that they can be adjusted as required. Customarily, the position of the stops will be so selected that the angles $\alpha$ and $\beta$ are of the same magnitude.

Figure 4:
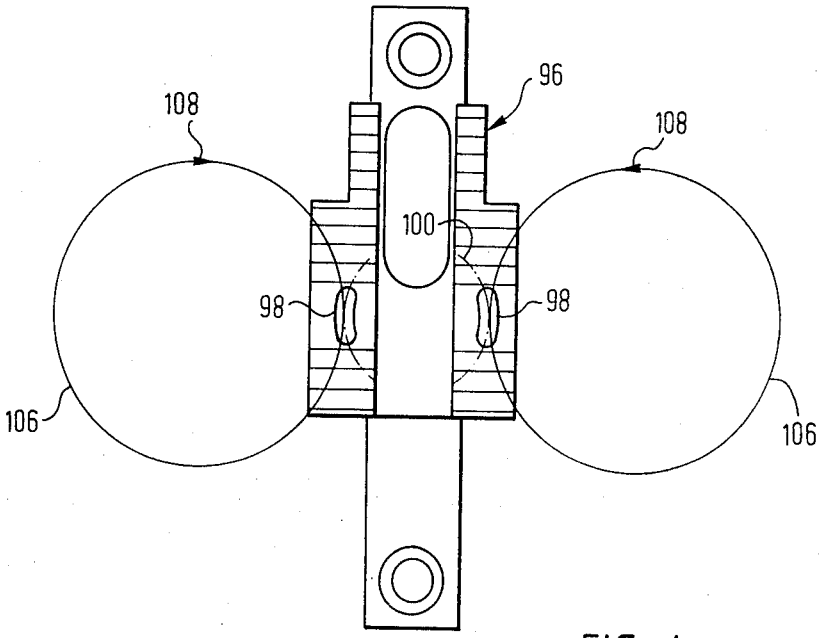
FIG. 4 is a top plan view of a transportation plate on an enlarged scale.

In order to make possible a passage of needles 18 and 20 through sewing table 12, even when needles 18, 20 are disposed in plane B—B or plane C—C, appropriately fashioned passage apertures must be provided. Thus, formed in a transportation plate 96, indicated only schematically in FIG. 1 inasmuch as same is conventional and known, and which is shown on an enlarged scale in FIG. 4, are slotted holes 98 which are curved in a circular-arc-shaped manner and the mean circle of curvature 100 corresponds to the circle which the needle tips describe upon a rotation of needle bar 14 about its longitudinal axis. The length of slotted holes 98, in this respect, is determined by the desired adjusting angles $\alpha$ and $\beta$.

Furthermore, as shown in FIG. 1, underneath sewing table 12, are two rotary grippers 104, of conventional construction, which rotate about vertical axes 102 and which are intended to co-operate with needles 18 and 20. The rotary grippers are conventionally arranged so that the gripper point runs at a very small spacing of about 0.1 mm past the needle tip and in so doing engages into the thread noose formed at the needle tip. A needle guard, offset slightly radially outwards relative to the gripper tip, ensures that the gripper tip cannot impinge against the needle. The path of the respect gripper tip of rotary grippers 104 is shown in FIG. 4 by circles 106. The direction of rotation of the grippers is indicated by arrows 108.

The needle movement and the movement of the rotary grippers must be so coordinated that the gripper tip respectively arrives at the location of the needle shortly after the needle has overcome its lower dead center and in this way a thread noose has been formed. In the ideal case, the gripper tip is disposed at this point in time at the location at which circles 100 and 106 practically touch.

By a swinging of the needle bar about its longitudinal direction, now in principle two difficulties could arise: (1) the needles, upon the swinging of the needle bar, could draw away from the path of revolution 106 of the gripper tips, so that the danger exists that the gripper tips no longer would engage into the thread nooses formed at the needle tip; (2) upon a swinging of needle bar 14 out of the normal position, the gripper tip of the one rotary gripper could reach somewhat earlier and the gripper tip of the other rotary gripper could reach somewhat later than normal the point nearest to the needle.

In practice, it has surprisingly been shown that the time coordination of the movement of the rotary grippers to the movement of the needles does not represent a problem. The two movements can be so coordinated to one another that the needles in all positions have already overcome their lower dead center when the respective gripper tip has reached the point on their path of revolution which is closest in the case of the respective needle position. In the case of the needle which has been swung in the direction of revolution of the associated gripper, the gripper tip does indeed reach the point nearest to the needle later than normal, but can nevertheless correctly grasp the thread noose.

Also the greater removal, occuring upon the swinging of the needle bar, of the needles from the path of revolution of the gripper tip does not represent any difficulty in the case of smaller angles of swing up to about 20°, since the thread noose formed is as a rule wide enough in order still to be grasped by the gripper tip even in such a case. However, in order to make possible larger angles of swing up to about 30°, the distance a between the tips of the two needles 18 and 20 is selected so as to be somewhat larger than the distance b between the two needle guard surfaces of the rotary grippers 104. The difference between these two distances can lie in the order of magnitude of 1.25 mm. The result of this is that, in the normal position of needles 18 and 20, the needle guard of the respective rotary gripper comes into abutment against the respective needle and forces this towards the axis of needle bar 14. Since the gripper tip is offset radially inwardly with respect to the needle guard, there is no danger that it remains suspended on the respective needle. If, on the other hand, needle bar 14 is swung out of the normal position, then needles 18 and 20 can spring outwardly in unimpeded manner and thereby remain, even in the positions corresponding to the planes B—B and C—C, near enough to the paths of revolution 106 of the gripper tips.

Figure 5:
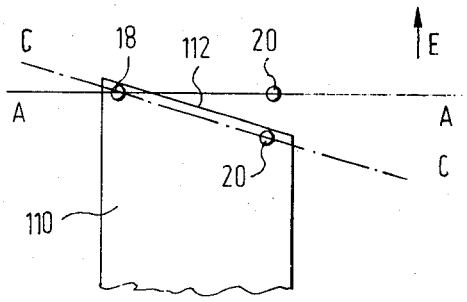
FIG. 5 is a schematic top plan view of a material part having a front edge extending obliquely to the feed direction to explain the mode of operation of the sewing machine.

The showing of FIG. 5 is intended to explain the sewing operation with the sewing machine. Onto a substrate (not shown), there is intended to be sewn a material part 110 whose leading edge does not extend perpendicularly, but obliquely relative to the feed direction E. If needle bar 14 were so placed that needles 18 and 20 are disposed in the normal position given by plane A—A, then needle 18 will have already plunged into material part 110 before needle 20 will have reached edge 112. In this way, a simultaneous locking at the start of the seam is not possible. If, on the other hand, needle bar 14 is so adjusted that needles 18 and 20 lie in plane C—C extending parallel to edge 112, both needles 18 and 20 will plunge simultaneously at the same distance from edge 112 into material part 110 so that both seams can be locked simultaneously at the start of the seam.

I claim:

1. A two-needle sewing machine comprising: a needle-bar drive, a needle bar coupled to the needle-bar drive and being reciprocable in the direction of its longitudinal axis and having two needles arranged spaced disposition as to each other, a holder for the needle bar for guiding the same upon its reciprocating motion, a sewing table having passage apertures for the needles, two rotary grippers arranged underneath the sewing table and being rotative about axes parallel to the longitudinal axis of the needle bar, the rotary grippers being spaced apart a distance slightly less than the spacing of the needles from each other, the needle bar (14) being guided in a torsionally-fast manner in the holder (26), the holder (26) being adjustable about the longitudinal axis of the needle bar between a normal position (A—A), in which a needle plane extending through both needles (18,20) is directed substantially perpendicular to the feed direction (E) of the goods to be sewn, and at least one oblique position (B—B, C—C) having the needle plane directed obliquely to the feed direction (E), and in that the passage apertures are formed by slotted holes (98) which are curved in circular-arc-shaped manner about the longitudinal axis of the needle bar and the length of which corresponds, in the angle extent to the adjusting angles ($\alpha$, $\beta$) of holder (26).

2. A two-needle sewing machine as claimed in claim 1, characterized in that the spacing (a) of the two needles (18, 20) from one another is slightly greater than the smallest distance (b), measured perpendicularly to the feed direction (E), between a needle guard of the one rotary gripper (104) and the needle guard of the other rotary gripper (104).

3. A two-needle sewing machine as claimed in claim 1, characterized in that the holder (22) comprises a U-shaped stirrup (26) in the U-limbs (34, 36) of which the needle bar (14) is guided so as to be axially displaceable and on the center web (28) of which there is fashioned a guideway (38) which is directed parallel to the longitudinal axis of the needle bar and on which a guide element (40), connected in torsionally-fast manner to the needle bar (14), is guided so as to be displaceable in the longitudinal direction of the needle bar (14).

4. A two-needle sewing machine as claimed in claim 3, characterized in that the guideway is formed by a groove (38), in the center web (28), into which the guide element (40) engages.

5. A two-needle sewing machine as claimed in claim 3 characterized in that the holder (26) is adjustable by means of an adjusting mechanism (56).

6. A two-needle sewing machine as claimed in claim 5, characterized in that the adjusting mechanism (56) comprises a piston/cylinder arrangement (64) which is actuated by pressure medium and which has a piston rod (70) which extends perpendicular to the longitudinal direction of the needle bar and which acts, by way of a linkage (54, 54) connected to it, on a point of the holder (26) which is situated outside the longitudinal axis of the needle bar.

7. A two-needle sewing machine as claimed in claim 6, characterized in that the linkage (54) is connected to a stop lever (76), the free end of which is movable between a stationary stop (80) and an operationwise adjustable stop (78).

8. A two-needle sewing machine as claimed in claim 7, characterized in that the adjustable stop (78) is adjustable by means of a second piston/cylinder arrangement (88) which is actuated by pressure medium.

9. A two-needle sewing machine as claimed in claim 3, characterized in that the slotted holes (98) are formed in a transportation plate (96) which is reciprocable in the feed direction (E).

* * * * *